US005381740A

United States Patent [19]

Johnston

[11] Patent Number: 5,381,740

[45] Date of Patent: Jan. 17, 1995

[54] PORTABLE SNACK TABLE

[76] Inventor: Ruby J. Johnston, 3387 Edsel, Detroit, Mich. 48217

[21] Appl. No.: 155,554

[22] Filed: Nov. 22, 1993

[51] Int. Cl.[6] ..... A47B 3/00

[52] U.S. Cl. ..... 108/167; 108/171; 108/115

[58] Field of Search ..... 108/115, 11, 13, 43, 108/166, 167, 168, 169, 170, 171, 172; 297/423.41

[56] References Cited

U.S. PATENT DOCUMENTS

| | | | |
|---|---|---|---|
| D. 24,421 | 6/1895 | Schaefer . | |
| D. 44,113 | 5/1913 | Rohrbeck . | |
| D. 88,355 | 11/1932 | Jalkut . | |
| D. 122,286 | 9/1940 | Fisher . | |
| D. 143,312 | 12/1945 | Harriton . | |
| D. 148,947 | 3/1948 | Olin . | |
| D. 213,599 | 3/1969 | Siebel . | |
| D. 265,026 | 6/1982 | Macho et al. . | |
| D. 267,214 | 12/1982 | Orenstein . | |
| D. 272,169 | 1/1984 | Nottingham et al. . | |
| D. 295,243 | 4/1988 | Oto . | |
| 706,868 | 8/1902 | Van Alstyne, Jr. | 108/168 |
| 768,168 | 8/1904 | Bridges | 108/167 |
| 1,193,876 | 8/1916 | Comey | 108/167 |
| 1,279,952 | 9/1918 | White | 108/166 X |
| 2,936,896 | 5/1960 | Friedman . | |
| 3,880,091 | 4/1975 | Heinonen . | |
| 4,462,636 | 7/1984 | Markson | 297/423.41 |
| 4,819,568 | 4/1989 | Coffrin | 108/13 X |

FOREIGN PATENT DOCUMENTS

| | | |
|---|---|---|
| 1072794 | 9/1954 | France . |
| 1126850 | 12/1956 | France . |
| 299578 | 11/1928 | United Kingdom . |

*Primary Examiner*—Jose V. Chen
*Attorney, Agent, or Firm*—Richard C. Litman

[57] ABSTRACT

A folding, short legged table particularly suitable for diverse application as in automobiles, in beds, and on lawns. A limited rotation piano hinge enables the table to fold for compact storage, and opposes collapse when in the deployed state. Indicia, preferably including pictorial representations of faces of animate objects, are located about the tabletop. These faces draw children's attention to the table, help define territorial areas, and amuse the children.

2 Claims, 2 Drawing Sheets

PORTABLE SNACK TABLE

BACKGROUND OF THE INVENTION

1. Field of the Invention

The present invention relates to a table, and more particularly, to a child's table which is collapsible for portability and which has short legs.

2. Description of the Prior Art

Tables have been designed to fulfill many purposes. To fulfill these purposes, some elements of the present invention have been employed in prior art tables and supports.

The concept of a short legged table is illustrated in U.S. Pat. Nos. Des. 24,421, issued to Paul F. Schaefer on Jun. 25, 1895; 44,113, issued to John E. Rohrbeck on May 27, 1913; 143,312, issued to David M. Harriton on Dec. 25, 1945; 148,947, issued to Norman E. Olin on Mar. 9, 1948; 265,026, issued to Jan M. Macho et al. on Jun. 22, 1982; and U.S. Pat. No. 3,880,091, issued to George W. Heinonen on Apr. 29, 1975.

Tables have been designed to be folded or disassembled for storage or conversion to another configuration in the prior art. U.S. Pat. No. 2,936,896, issued to Samuel Friedman on May 17, 1960, and French Pat. Document No. 1,126,850, dated Dec. 3, 1956, both disclose tables having table platform surfaces formed in two parts and being foldable along a common joint existing between the two parts. In both cases, there are supporting struts or the like attached to the legs.

The stool of Macho et al. '026 is disclosed as being foldable, but no hinging of the table platform is disclosed in the drawing figures.

A knock-down table having a table platform formed in plural parts is seen in French Pat. Document No. 1,072,794, dated Sep. 15, 1954. The plural parts separate when the table is dismantled, and are not mutually hinged.

Indicia dividing a table platform surface into plural segments is seen in U.S. Pat. No. Des. 88,355, issued on Nov. 22, 1932 to Lee D. Jalkut. The entire tabletop is so divided.

Indicia providing animate features on a table is shown in U.S. Pat. Nos. 122,286, issued to Gorman L. Fisher on Sep. 3, 1940, 267,214, issued to Henry Orenstein on Dec. 14, 1982, and 272,169, issued to John R. Nottingham et al. on Jan. 10, 1984. The inventions of Nottingham et al. '169 and Fisher '286 are directed to adornment of tabletops. The former also divides a portion of the tabletop into segments, these divisions occurring in the center of the tabletop.

None of the above inventions and patents, taken either singly or in combination, is seen to describe the instant invention as claimed.

SUMMARY OF THE INVENTION

The present invention provides a convenient, portable table ideally suited to certain applications, particularly for use by children. The table has a platform of two complementary sections, foldable along a hinge attached to both sections, and four short legs. The ability of the table to fold along the joint between the sections greatly improves portability, and further renders the table more easily stored. In the folded configuration, it is much more compact. In one embodiment, the hinge limits rotation to ninety degrees, so that the two sections form an L. In this condition, the snack table is readily stored while leaning against two walls in the corner of a room.

The short legs render the table suitable in many situations wherein children sit with legs extended, such as on a lawn, on a floor, as while watching television, or in bed. The tabletop is supported at a convenient low level, providing clearance for the legs, but maintaining the tabletop sufficiently low that children can reach most parts thereof. This characteristic leads to advantageous use of the snack table in an automobile.

The table preferably includes indicia depicting a series of animate faces or other representations, spaced peripherally around the tabletop. When several children are seated about the snack table, these indicia serve to attract attention of the children, amuse them, and demarcate individual places in an inoffensive manner.

Therefore, novelty and utility of the snack table reside in the particular combination of features making the novel table convenient for portability, and attractive to and suitable for children.

Accordingly, it is a principal object of the invention to provide a table wherein the tabletop is formed in two sections meeting along a common joint, and being pivotably connected therealong.

It is another object of the invention to hinge the two tabletop sections together, such that the tabletop is secured in place without apparatus connected to the table legs.

An additional object of the invention is to arrange the swing of the hinge such that as the tabletop sections approach one another, the table legs project outwardly, on sides of the tabletop sections away from the approaching surfaces, whereby the hinge opposes collapse of the snack table when erected.

It is a further object of the invention to arrange the hinge to limit swing of the tabletop sections to ninety degrees.

Still another object of the invention is to provide indicia located on the tabletop attracting and amusing children.

It is again an object of the invention to provide indicia located on the tabletop demarcating individual places.

Yet a further object of the invention is to provide a table with proportionally short legs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
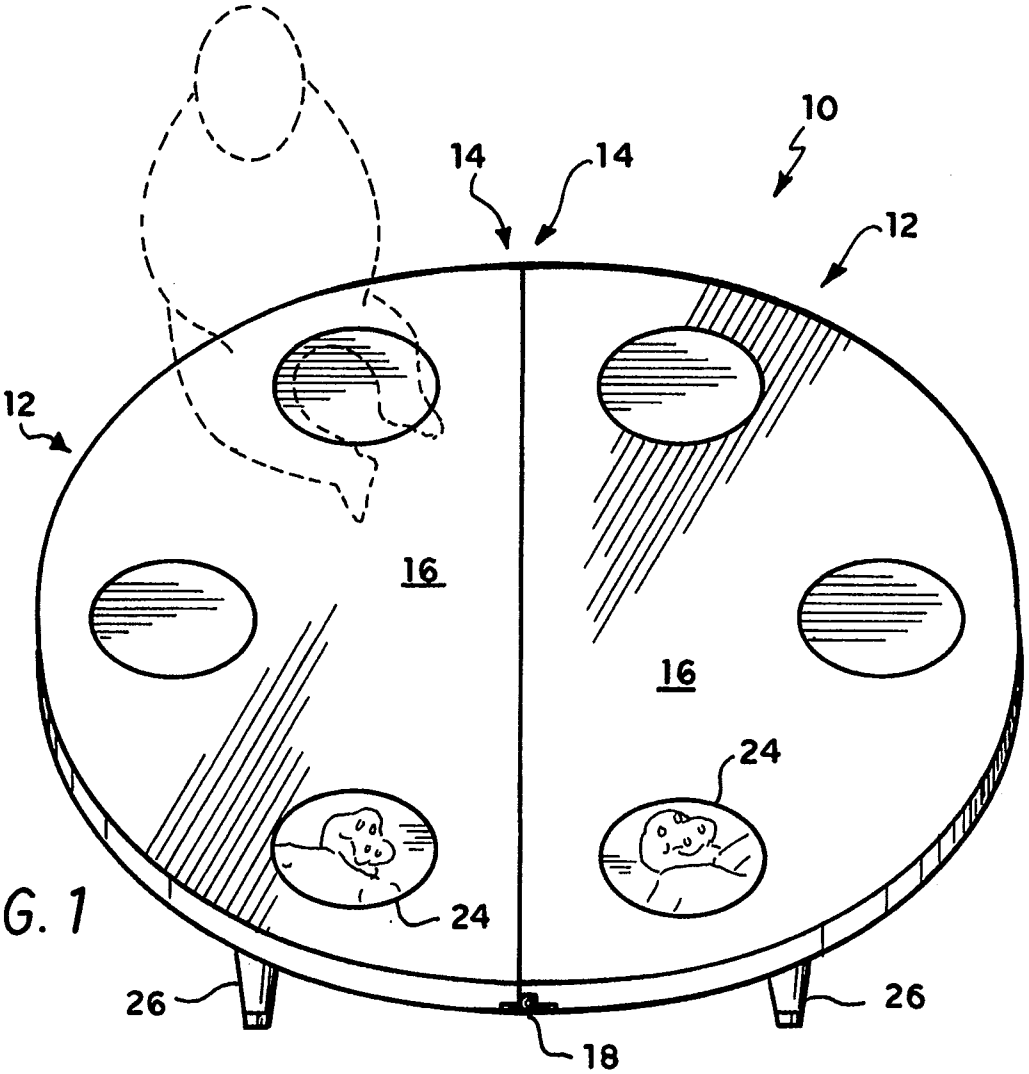
FIG. 1 is an environmental, perspective view of the invention.

Turning now to FIG. 1 of the drawings, the novel snack table 10 is shown erected to assume a deployed condition. Table 10 includes two platform members 12,12 which are hinged along adjoining edges 14,14. When in the deployed condition, that is, when platform members 12,12 are arranged in coplanar relation, as seen in this figure, they collectively provide a planar upper surface 16.

Figure 2:
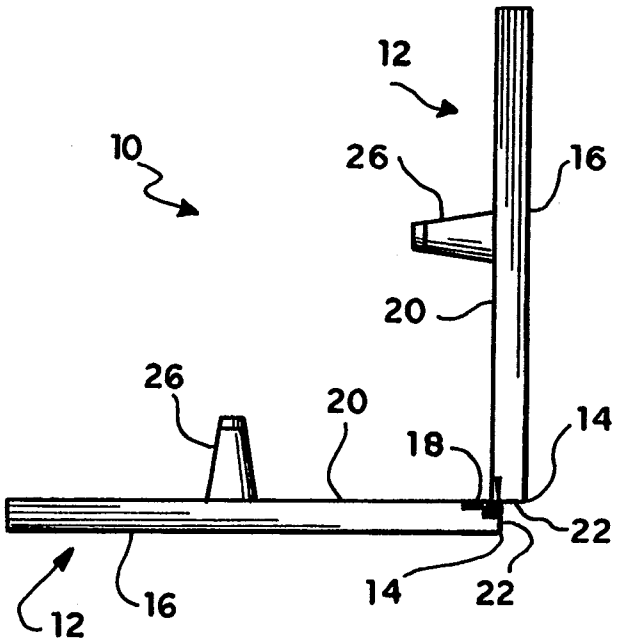
FIG. 2 is a side elevational view of the novel table, folded to a point of ninety degrees, drawn to reduced scale.

A hinge 18 attached to both platform members 12,12 is oriented such that either platform member 12 may be swung as shown in FIG. 2, but not in the opposite direction. This opposes spontaneous collapse of table 10 while in the deployed or operative condition.

Figure 4:
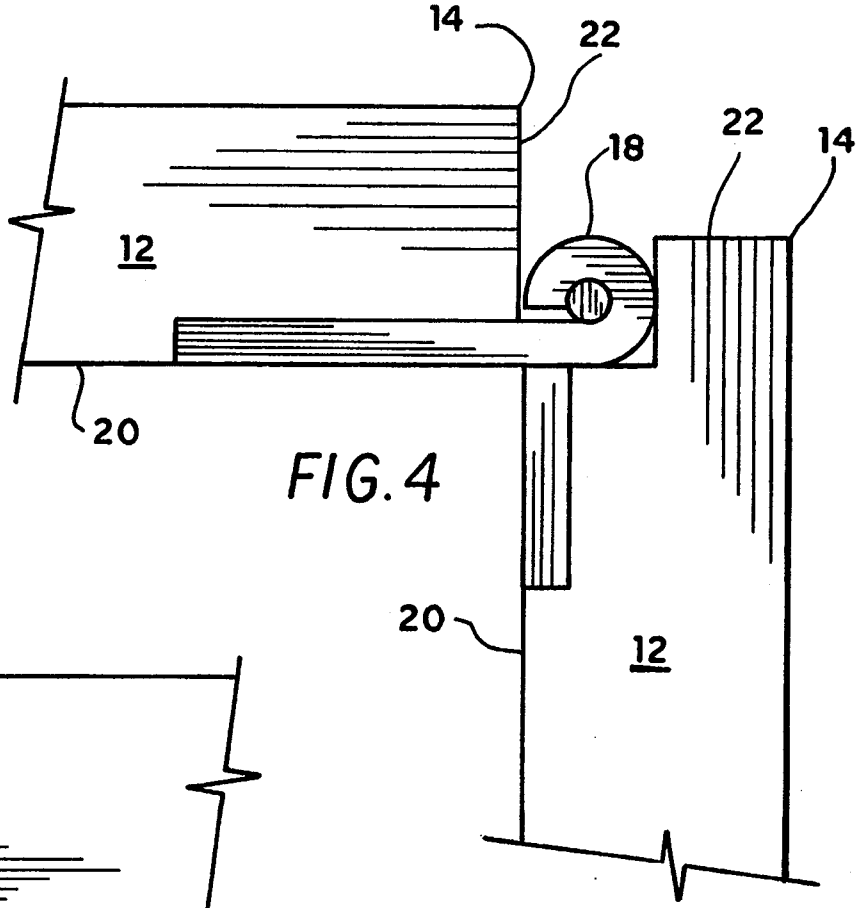
FIGS. 3 and 4 are side elevational detail views of a piano hinge enabling folding of the table, showing the table open and folded, respectively, and drawn to enlarged scale.
Figure 3:
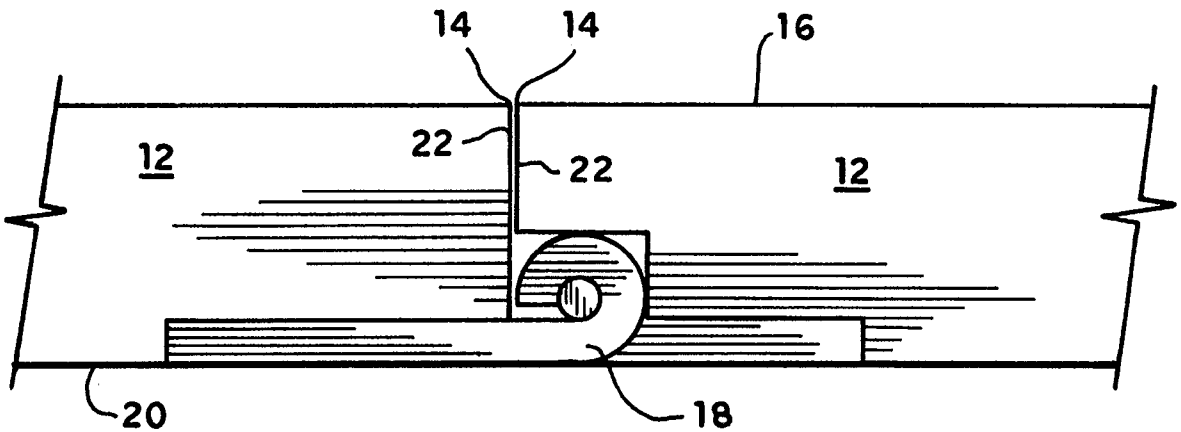

Hinge 18 is shown in greater detail in FIGS. 3 and 4. In the former view, platform members 12,12 are shown in the deployed condition. With hinge 18 located toward the bottom sides 20,20 of platform members 12,12, abutting surfaces 22,22 oppose collapse, while presenting substantially uninterrupted upper surface 16 to users. Hinge 18 is thus substantially concealed. Hinge 18 is revealed when snack table 10 is folded, as shown in FIG. 4. Preferably, hinge 18 is of a commonly known piano type hinge providing limited rotation of ninety degrees, which limits swing to the right angle depicted in this view.

Returning to FIG. 1, table 10 is seen to include indicia 24 depicting animate faces, spaced about the periphery of table surface. This indicia 24 not only attracts and amuses children, but suggests territorial limitations to which children can be confined by a supervising adult.

Short legs 26 are attached to and depend from platform members 12. An optimum balance of uncomplicated construction and table stability is provided by four legs 16. However, any number of legs 16 in excess of three will stabilize table 10 on a flat surface.

In a preferred embodiment, diameter of upper surface 16 is thirty-six inches (100 cm), and length of legs 26 is within a range of four to five inches (10 to 13 cm). These values provide optimum utility for children below ten years of age. Table 10 is, of course, suitable for any age, and optimum utility is realized when the diameter, or length and width dimensions, of upper surface 16 exceeds leg length by a factor of five to fifteen.

It is to be understood that the present invention is not limited to the sole embodiment described above, but encompasses any and all embodiments within the scope of the following claims.

I claim:

1. A snack table for use by children, said table comprising:

first and second platform members, each of said platform members having an upper surface and an adjoining edge, said platform members collectively providing a horizontal table surface to define a deployed condition;

hinge means pivotally attaching said first platform member to said second platform member along said adjoining edges;

said hinge means allowing downward rotation of said platform members to define a stored condition;

said hinge means including means for limiting downward rotation of said platform members while in the stored condition, whereby said table is foldable to said stored condition, such that said platform members form substantially an L configuration;

said hinge means further including means for limiting upward rotation of said platform members to prevent said table from collapse while in the deployed condition;

a plurality of legs fixedly attached to and depending downwardly from said platform members, each of said legs having a substantially similar, predetermined length;

said table surface including a substantially horizontal width, wherein said width is within the range of five to fifteen times greater than said leg length; and indica demarcating individual places on said platform member upper surface, said indicia comprising representations of animate objects having faces, whereby a child's attention is drawn to said individual places and a child is amused thereby.

2. The snack table according to claim 1, wherein the table surface is substantially circular.

* * * * *